US005327752A

United States Patent [19]

Myers et al.

[11] Patent Number: 5,327,752

[45] Date of Patent: Jul. 12, 1994

[54] COMPUTER EQUIPMENT LOCK

[75] Inventors: Gary L. Myers, River Grove, Ill.; Stewart Carl, Palo Alto; Arthur H. Zarnowitz, Burlingame, both of Calif.

[73] Assignee: Kensington Microwave Limited, San Mateo, Calif.

[21] Appl. No.: 119,314

[22] Filed: Sep. 9, 1993

Related U.S. Application Data

[63] Continuation of Ser. No. 891,783, Jun. 1, 1992, abandoned.

[51] Int. Cl.[5] ..... E05B 69/00

[52] U.S. Cl. ..... 70/58; 70/14; 70/491; 70/57; 248/553

[58] Field of Search ..... 70/57, 58, 14, 18, 30, 70/49, 232, 491; 248/551, 553, 505

[56] References Cited

U.S. PATENT DOCUMENTS

| | | | |
|---|---|---|---|
| 3,785,183 | 1/1974 | Sander | 70/58 |
| 3,859,826 | 1/1975 | Singer | 70/371 |
| 4,057,984 | 11/1977 | Avaiusini | 70/58 |
| 4,858,455 | 8/1989 | Kuo | 70/491 |
| 4,938,040 | 7/1990 | Humphreys, Jr. | 70/58 |
| 5,024,072 | 6/1991 | Lee | 70/491 |

FOREIGN PATENT DOCUMENTS

| | | | |
|---|---|---|---|
| 1376011 | 12/1974 | United Kingdom | 70/491 |

*Primary Examiner*—Darnell M. Boucher
*Attorney, Agent, or Firm*—Townsend and Townsend Khourie and Crew

[57] ABSTRACT

An axial pin tubular lock for use in securing portable computers and other devices having spindle-accepting ports. The lock is bade up of an outer shell attached to a cable, an inner shell, a rotatable driver sleeve, a stationary tumbler sleeve, a rear scuff plate held in place by a combination of an adhesive and cooperative geometric engagement with the outer shell, a locking spindle extending through the driver and tumbler sleeves, a retaining plate and an anti-rotation extension which may be integrally formed with the retaining plate. The rotatable driver sleeve is equipped with an internally disposed detent which engage a groove on the spindle, thereby providing proper axial and radial alignment between the spindle and the driver sleeve. The internal surface of the stationary tumbler sleeve has an indented support surface, thus providing spindle support while permitting passage of the spindle head through the tumbler sleeve during assembly. The tumbler sleeve is held in place by a pin which engages a slot located on the sleeve's outer perimeter and by the retaining plate which is disposed against the sleeve's rearward face. The retaining plate is, in turn, held in place by both a spring and the spline detail of the inner shell. The spindle itself incorporates a curved surface design which distributes forces more evenly across the spindle surface, thereby reducing the potential for spindle failure.

7 Claims, 5 Drawing Sheets

COMPUTER EQUIPMENT LOCK

CROSS REFERENCES TO RELATED APPLICATIONS

This is a continuation of prior U.S. patent application No. 07/891,783 now abandoned, filed Jun. 1, 1992.

FIELD OF THE INVENTION

The present invention relates generally to tumbler locks and, more particularly, relates to a tumbler lock for use in securing a portable computer or other suitably adapted object in one location.

BACKGROUND OF THE INVENTION

In the past several years the use of portable computers and other high-priced, portable electronic devices have increased dramatically. While the size of these devices promotes efficiency due to their ease of transportation, the portable nature of these devices also renders them susceptible to theft. Accordingly, as these devices become increasingly portable, there is a corresponding need to enhance the theft protection of these devices through adaptable locking means.

A variety of tumbler locks, such as the well-known axial pin tubular locks, are presently available for use in applications such as vending machines. Such locks, however, have been used primarily in locking applications associated with stationary objects.

Prior to the present invention, no acceptable lock specifically adapted for use in securing portable computers or similar devices has been available. Rather, users of these portable devices have relied primarily on secondary security measures, such as maintaining the device in a locked drawer when not in use, or attaching a locking device to the handle of the computer for securement during periods of non-use. These security measures, however, have proved highly ineffective due to the ease with which they are overcome. A shortcoming of utilizing a chain or some other standard device around the handle of a portable computer lies in the fact that the handle may be easily broken away with relatively little effort, thereby permitting the theft of the computer or other protected apparatus. Locking the computer in a storage area such as a desk drawer or a file cabinet, when not in use, represents an alternative solution to the potential threat of theft. As will be recognized, however, such securement measures may lead to decreased efficiency regarding the use of the computer due to the expenditure of additional time and effort in securing the computer in the storage area and then retrieving it prior to use.

Accordingly, it has been proposed that a lock which may be inserted into a standardized and dedicated locking aperture within the body of a portable computer or other device to be secured would overcome the prior disadvantages and problems. Such a lock should have high security attributes which will preclude a thief from easily overcoming the lock by means of either picking or forced disengagement of the lock due to withdrawal of the locking member.

OBJECTS AND SUMMARY OF THE INVENTION

It is the general aim of the present invention to provide an improved computer equipment lock of an axial pin tubular configuration which is easily operated and securely attachable to a standardized dedicated slot provided in a computer housing or the like. It is a related object to provide such a computer equipment lock which is highly resistant to picking or other disengagement attempts.

It is yet a further object to provide a computer equipment lock of the foregoing type which can be economically manufactured and is based on an uncomplicated locking mechanism.

These and other objects of this invention are realized by providing a lock having an inner shell and an outer shell, with the outer shell comprising a front portion and a rear portion. The front portion of the outer shell is attached to a looped cable which may be wrapped around a solid stationary object and then placed over the lock prior to the insertion of the lock's spindle head and anti-rotation extension arms into a dedicated computer port, thereby creating a closed security loop. The rear portion of the outer shell is in sliding engagement with the remainder of the lock assembly and is spring-biased toward the spindle head. Hence, after insertion of the spindle head into the computer, the rear portion of the outer shell will move towards the head and hence eliminate any gap between the lock assembly and the computer which might otherwise exist, thereby preventing manipulation of the spindle or anti-rotation arms. The anti-rotation arms, which may be attached to plate means disposed within the lock body, prevent disengagement of the spindle head through rotation of the lock shell. The sliding engagement of the rear portion of the outer shell is permitted by the use of slotted engagement means between the outer shell and the inner shell.

In operation, locking rotation of the spindle is permitted by the rotation of a driver pin sleeve which is connected to the spindle. This connection between the driver pin sleeve and the spindle is effected by means of a slotted indenture and pin means. This slotted indenture further prevents the withdrawal of the spindle from the locking mechanism by means of abutting engagement with detent means located on the inner surface of the drive sleeve. The locking mechanism of the present invention is provided with a retaining plate abutting a non-rotatable tumbler sleeve. Both the pin plate and adjacent tumbler sleeve are provided with central slots matching the general geometry of the spindle head, thereby permitting the withdrawal of the spindle only when the head is properly aligned. The pin plate is held in place by a combination of spring means and the splined configuration of the inner shell. The tumbler sleeve is held in place by pin means disposed through the inner sleeve and engaging slotted indenture means on the outer perimeter of the tumbler sleeve. Finally, the spindle itself makes use of a gradual tapered transition zone between the spindle body and neck, thereby substantially reducing the likelihood of spindle failure.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
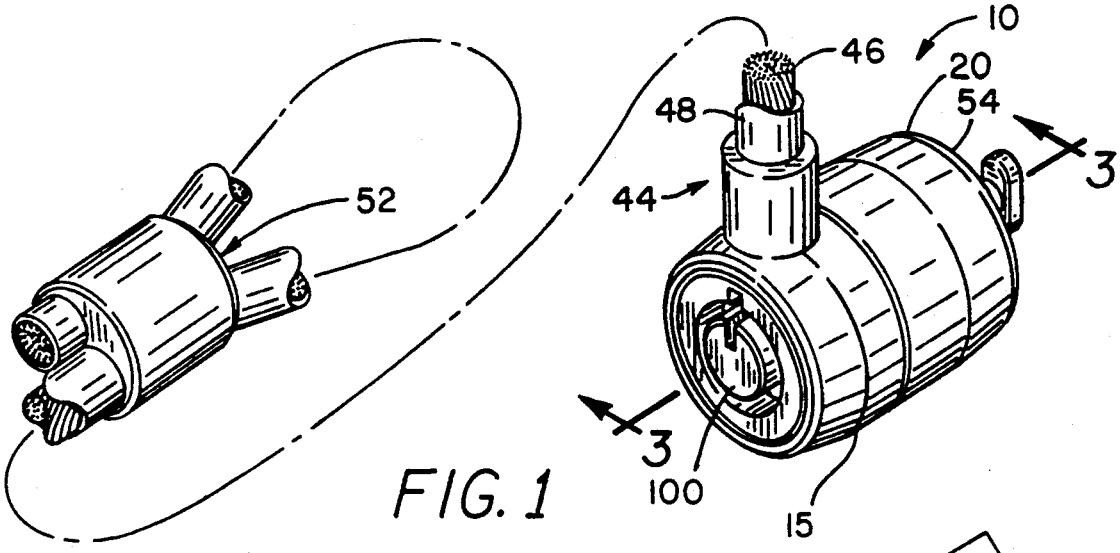
FIGURE 1 is a perspective view of the computer equipment lock of the present invention.
Figure 2:
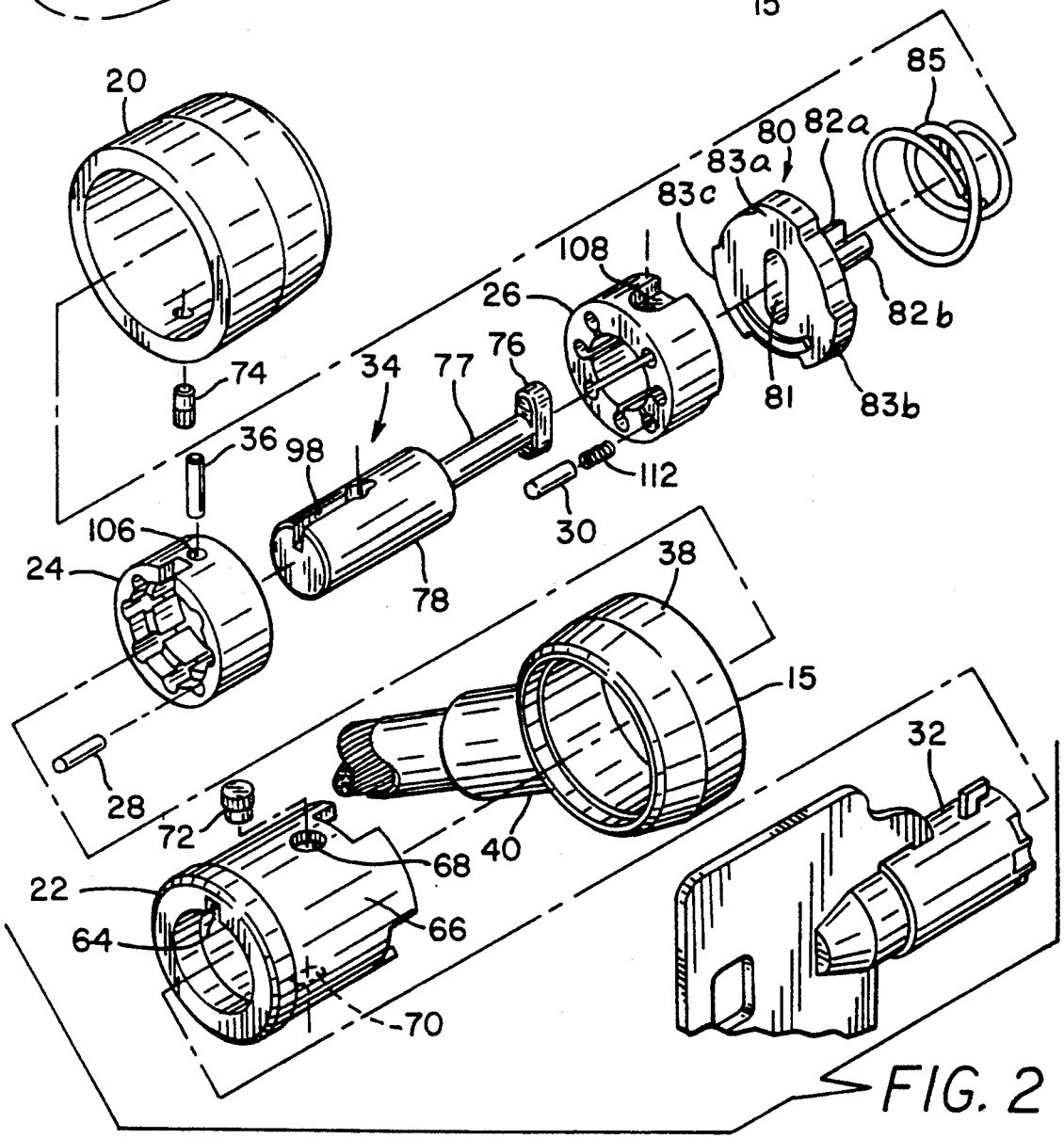
FIG. 2 is an exploded perspective view of the computer equipment lock according to the preferred embodiment of the present invention.
Figure 3:
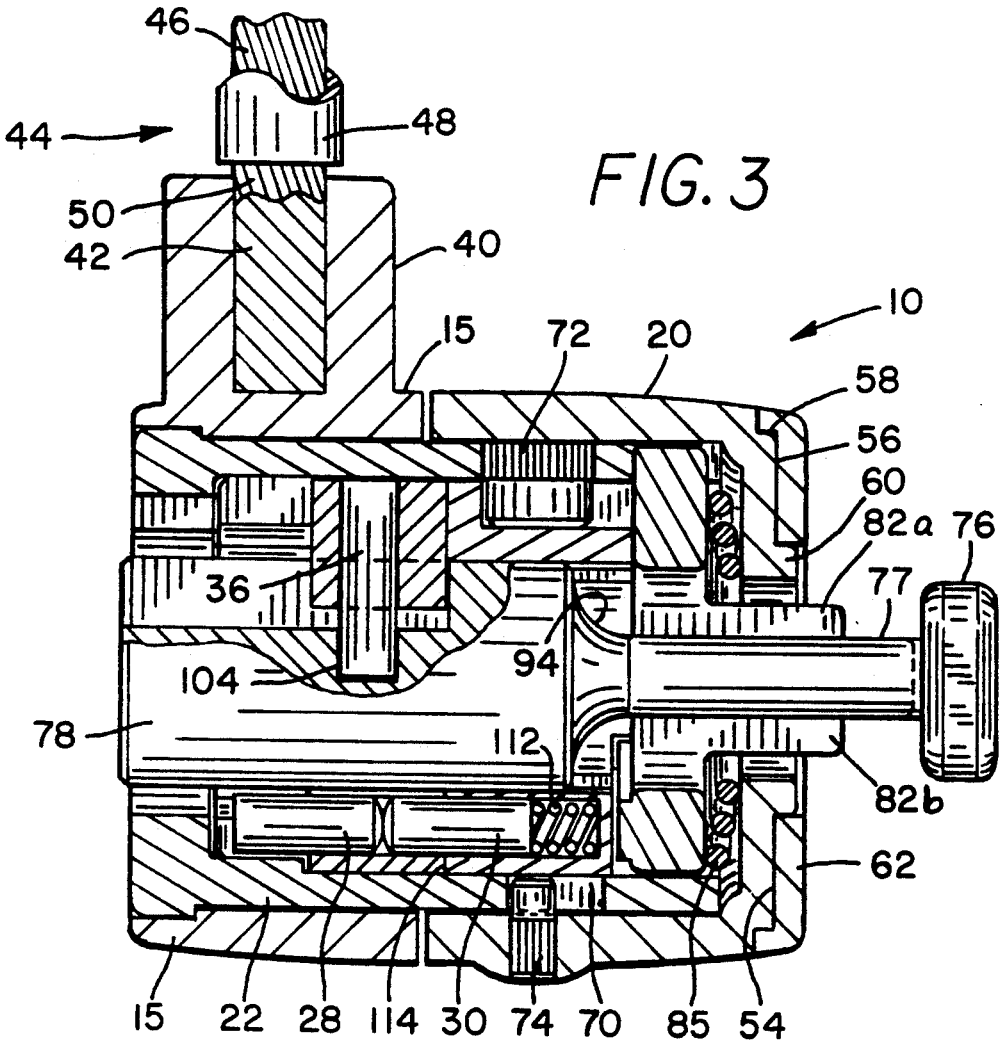
FIG. 3 is a sectional side view of the computer equipment lock taken along line 3—3 of FIG. 1.

Referring now to FIGS. 1–3, a tubular lock 10 according to the preferred embodiment of the present invention is shown generally in FIG. 1, in exploded view in FIG. 2, and in cross section in FIG. 3. The lock 10 includes an outer shell having a forward portion 15 and a rear portion 20. Housed within the outer shell is a non-rotatable inner shell 22 as best seen by reference to FIG. 2. Telescoped within the inner shell 22 is a rotatable driver sleeve 24. In the assembled state, the rotatable driver sleeve 24 is disposed in face to face relation with non-rotatable tumbler sleeve 26. As will be discussed more fully below, the rotatable driver sleeve 24 houses a multiplicity of driver pins 28 which cooperatively depress spring biased tumbler pins 30 housed within the non-rotatable tumbler sleeve 26 upon insertion of a proper key member 32 (FIG. 2), thereby permitting relative rotation of driver sleeve 24. Extending through sleeves 24, 26 is a locking spindle 34, described in greater detail below. As described more fully below, connecting means 36 are disposed between rotatable driver sleeve 24 and locking spindle 34, thereby serving to transmit the rotational movement of driver sleeve 24 to the spindle 34.

In the preferred embodiment of the present invention, the forward portion 15 of the outer shell comprises a cable ring structure as shown most clearly in FIGS. 2 and 3. The cable ring structure comprises a substantially circular body portion 38 and an integrally formed stem portion 40. As seen most clearly in FIG. 3, the stem portion 40 is provided with a substantially hollow center portion 42 which may receive cable means 44.

As shown, the preferred embodiment of the cable means for use in the present invention includes an internal core 46 formed from stainless steel aircraft cable and an external sleeve 48 formed from PVC or a like material. The internal core includes a proximal end portion 50 which extends beyond the end of the sleeve 48. As illustrated, in the preferred embodiment the proximal end portion 50 of the cable core 46 is receivable within the hollow center portion 42 of the outer shell stem 40.

As illustrated in FIG. 1, the distal end of the cable 44 is formed into a loop 52 in a manner well known to those skilled in the art. In operation of the lock 10, the loop 52 may be either connected to a stationary body by means o#a second locking device (not shown) or passed over the rear end 20 of the tubular lock prior to insertion of the spindle into an appropriate locking port, thereby creating a locked circuit between the tubular lock 10 and the attached cable means 44.

As will be appreciated by those skilled in the art, the use of PVC sleeve 48 to cover the cable means 46 permits the cable means to be wrapped around stationary objects prior to the loop 52 being disposed over the lock 10 of the present invention without damaging the surface of the stationary object.

As best seen by reference to FIG. 3, in the preferred embodiment of the present invention, the rear portion 20 of the outer shell is provided with a rear surface 54 of a stepped configuration. Essentially, the rear surface 54 is comprised of a substantially planar section 56 having a lowered shoulder member 58 at the perimeter of the outer shell and a raised shoulder member 60 at the interior thereof.

In keeping with the preferred embodiment of the present invention, a scuff plate 62 will be attached to the rear surface 54 of the outer shell 20. The scuff plate 62 is secured in place by adhesive means as are well known to those skilled in the art as well as by geometric cooperation with shoulder members 58, 60 of rear surface 54.

Disposed within the outer shell portions 15, 20 is an inner shell 22 which is shown most clearly in FIG. 2. As shown, the forward face of the inner shell 22 has a substantially circular perimeter with indent means 64 for properly aligning and guiding key 32 into contacting relation with driver pins 28. The body portion 66 of the inner shell 22 is of a substantially solid cylindrical configuration. As shown, a bore hole 68 and a slot 70 are disposed within inner shell 22 for respectively accepting a first retaining pin 72 and a second retaining pin 74.

As shown most clearly in FIG. 3, retaining pin 72 is disposed between inner shell 22 and non-rotatable tumbler sleeve 26 while retaining pin 74 is disposed between the outer shell 20 and slot 70 housed within inner shell 22. As will be appreciated, this attachment permits the rear portion 20 of the outer shell to slide with relation to inner shell 22 and spindle 34.

In a preferred embodiment of the present invention, the spindle 34 will comprise a head portion 76, a neck portion 77 and a body portion 78. The spindle head 76 and neck 77 will preferably form a T-shaped cross section. In actual locking operation, the T-shaped spindle will be inserted into a slot provided in a computer or other portable device to be secured (not shown). The geometry of the slot should be such that the head 76 of spindle 34 may be inserted or withdrawn only when the spindle and slot are properly aligned. The rotatable driver sleeve 24 and connected spindle 34 will then be rotated approximately 90° in the manner described below, thereby preventing the withdrawal of the lock 10 through the application of an axial force.

Figure 4A:
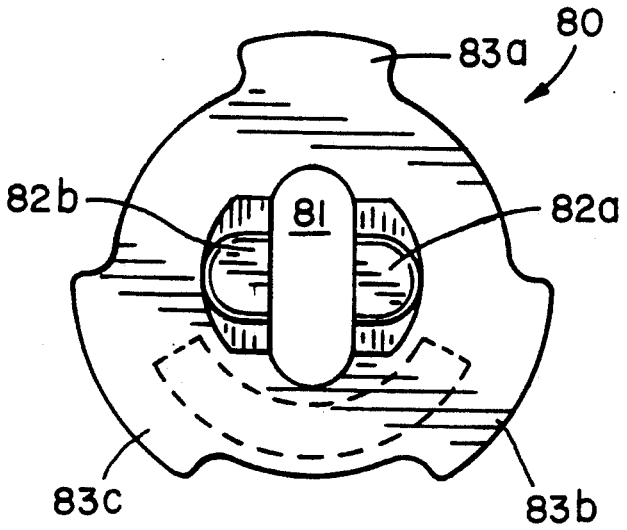
FIGS. 4A–B are end and side views of the retaining plate for use in the computer equipment lock of the present invention.
Figure 4B:
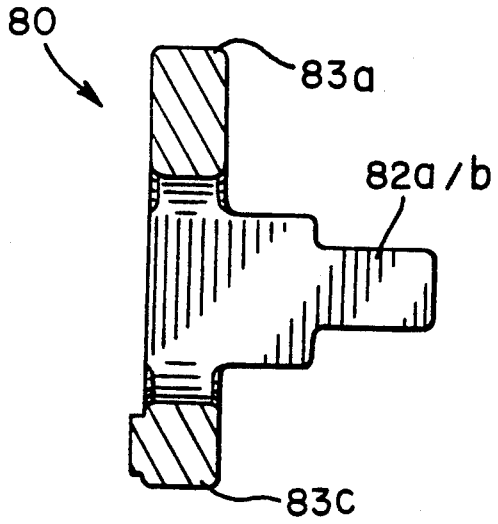

In order to prevent the disengagement of the lock through the rotation of the entire mechanism, the preferred embodiment of the present invention is provided with a retaining plate 80 which is illustrated in FIGS. 2, 4A and **4*b*. Retaining plate 80 includes a slotted passage 81 through which spindle head 76 may pass when the spindle 34 and retaining plate 80 are properly aligned. The retaining plate 80 also preferably includes extensive members 82*a*, 82*b* which will extend rearwardly along spindle neck 78 after insertion of spindle head 76 through passage 81. As will be recognized by those skilled in the art, when the retaining plate 80 and spindle 34 are properly aligned as shown in FIG. 3, extensive members 82*a*, 82*b* may "follow" the head 76 into an appropriate slot provided in the device to be secured. During rotation of spindle head 76 within the slot provided in the computer, members 82*a*, 82*b*** remain stationary. Hence, the potential for rotational manipulation of the lock is substantially eliminated.

As will be recognized, in order to provide a high degree of security, the retaining plate 80 must be well secured against rotation within the lock 10. In a preferred embodiment of the present invention, this securement is achieved by means of the cooperative geometric engagement between peripheral segments 83*a*–83*c* and the matching spline detail of inner shell 22.

Once the head 76 and retaining plate members 82*a*, 82*b* are in locked engagement with the device to be secured, internally disposed spring means 85 serve to bias rear portion 20 of the outer shell towards the spindle head 76, thereby reducing the gap between rear scuff plate 62 and the slot provided in the computer or other device, thereby substantially covering the anti-rotation arms 82*a*, 82*b* and reducing the potential for lock manipulation and damage. The internally disposed spring means 85 also provide axial force directed against retaining plate 80, thereby providing added stability to the overall lock structure.

Figure 5:
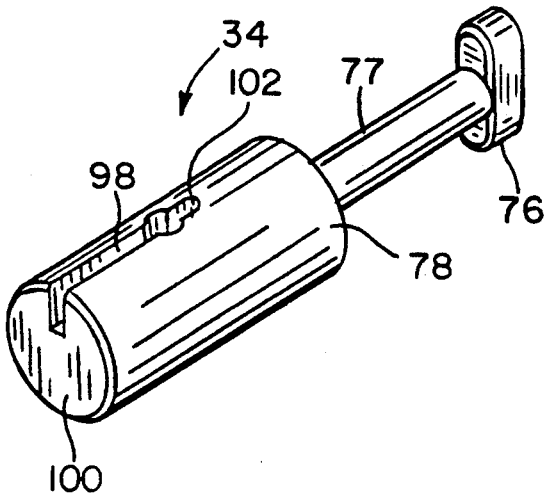
FIG. 5 is an isolated perspective view of a locking spindle for use in the computer equipment lock of the present invention.

The preferred embodiment of the spindle for use in the lock of the present invention is shown in FIG. 5. As illustrated, the spindle is substantially "T" shaped and includes a substantially cylindrical body portion 78 and a substantially cylindrical neck portion 77 having a diameter which is less than that of the body portion 78. As previously indicated, head portion 76 is disposed at the end of neck portion 77 to form a T-shaped member for insertion into a geometrically similar slotted port on the portable computer or other device to be secured. In the preferred embodiment of the present invention, the largest cross sectional dimension of the spindle head 76 will slightly exceed the diameter of the body portion 78, thus precluding withdrawal of the spindle through driver sleeve 24. The smallest cross sectional dimension of the spindle head will preferably be substantially equivalent to the diameter of the neck portion 77.

Figure 6A:
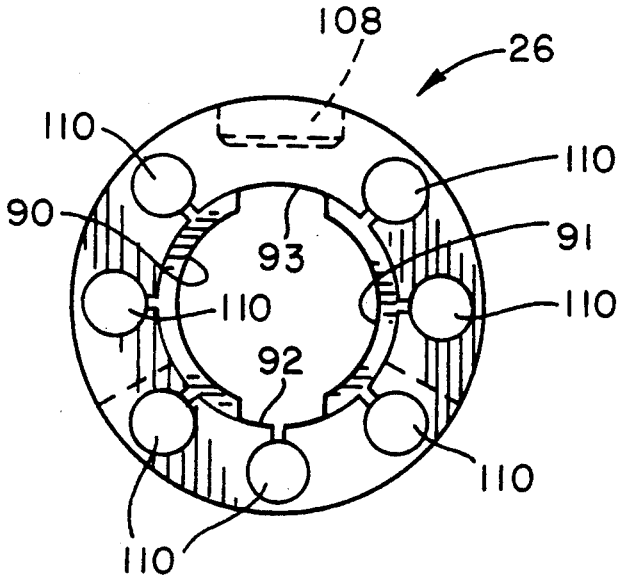
FIGS. 6A–B are front and rear views of a stationary tumbler sleeve for use in the computer equipment lock of the present invention.
Figure 6B:
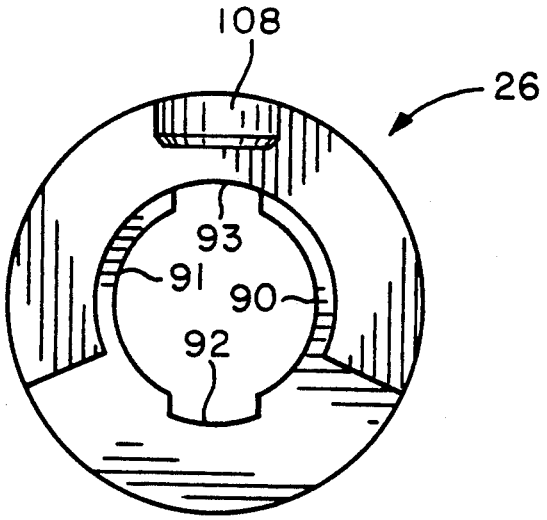

The significance of this spindle design is best understood by reference to FIGS. 6A and 6B showing, respectively, forward and rear views of the non-rotatable tumbler sleeve 26. As illustrated, the inner surface of the tumbler sleeve 26 is provided with support surfaces 90, 91 which are maintained in contacting relation with the outer surface of body portion 78 of spindle 34. The inner surface of the tumbler sleeve is also provided with indentures 92, 93 which permit spindle head 76 to pass through the tumbler sleeve 26 when the proper respective alignment between these components is achieved. The non-rotatable tumbler sleeve thus provides a stable support for the spindle 34 while at the same time permitting passage of the spindle head 76 during the assembly process.

With regard to one important aspect of the present invention, the spindle 34 is provided with a gradual transition zone 94 (FIG. 3) located between neck 77 and body portion 78. As will be recognized, the use of such a rounded transition zone reduces the potential for spindle failure since the forces applied to the spindle are distributed across a broad surface, thus avoiding the concentration of forces at one location. Conversely, spindles utilized in the past have often incorporated sharp-edged transition zones, leading to the potential for catastrophic failure at high energy surfaces such as corners and the like.

Figure 7A:
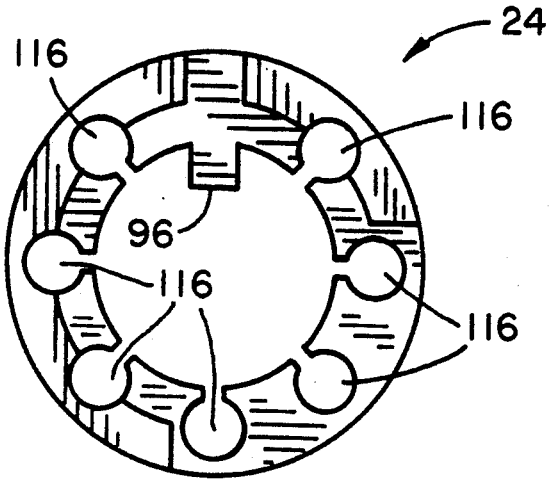
FIGS. 7A–B are front and rear views of a rotatable driver sleeve for use in the computer equipment lock of the present invention.
Figure 7B:
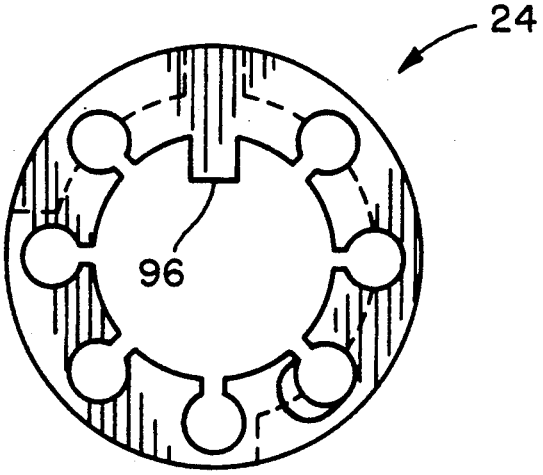

The forward and rear faces of rotatable driver sleeve 24 are illustrated in FIGS. 7A and 7B respectively. As shown, the driver sleeve is provided with internally disposed detent means 96 extending into the central portion thereof. As shown in FIG. 5, the body portion 78 of spindle 34 is provided with a groove 98 extending from the forward face 100 of the spindle to a point 102 lying forward of the neck portion 77. In an important aspect of the present invention, groove 98 cooperatively engages the detent means 96 of the driver sleeve 24. Accordingly, when the spindle 34 and the driver sleeve 24 are in engagement, relative axial movement is restricted by the length of the groove 98.

As best illustrated in FIG. 3, the groove 98 in spindle 34 is of a substantially uniform depth over its entire length except for a depressed bore 104. As previously indicated, the driver sleeve 24 and the spindle 34 are attached by connecting pin 36 illustrated in FIGS. 2 and 3. This connecting pin 36 is inserted through the driver sleeve bore hole 106 and into depressed bore 104 located in groove 98. As will be appreciated by those skilled in the art, the placement of depressed bore 104 within groove 98 enhances the ease of assembly since proper radial alignment between the driver sleeve 24 and spindle 34 is readily achieved through engagement of the detent means 96 with groove 98.

In addition to the proper radial alignment between the driver sleeve 24 and spindle 34, proper axial alignment between these components is also needed for insertion of pin 36 through the driver sleeve bore hole 06 and into the spindle bore hole 104. In the preferred embodiment of the present invention, the driver sleeve bore hole 106 and spindle bore hole 104 will be properly aligned when the detent 96 of the driver sleeve comes into abutting relation with the terminal point 102 of groove 98, thus substantially simplifying the insertion of connecting pin 36.

Ease of assembly in the lock 10 of the present invention is further enhanced by the use of slotted pin engagement means 108 on the outer surface of non-rotatable tumbler sleeve 26. As illustrated in FIGS. 2 and 3, rotation of tumbler sleeve 26 is prohibited by means of a retaining pin 72 and engaging slot 108. As will be appreciated, the use of slot 108 rather than a bore hole enhances the ease of assembly as well as simplifying the manufacturing process, since the need to achieve close tolerances between the inner shell 22 and the tumbler sleeve 26 of each individual lock is substantially reduced.

With regard to the actual locking manipulation of driver sleeve 24 and spindle 34, a series of angularly spaced tumbler pins 30 are slidably positioned within bores 110 defined through the non-rotatable tumbler sleeve 26 (FIG. 6A) and function to normally retain the spindle 34 in its locked position wherein rotational movement is prohibited. The tumbler pins 30 are invariably urged forward by means of coiled compression springs 112. These coiled compression springs are disposed within the bores 110 which retain the tumbler pins. Under the urging of the springs 112, the tumbler pins 30 are disposed along the bores 110 in such a manner that the outer ends of the pins normally project outward beyond the shear plane 114 (FIG. 3) formed at the inner face of the tumbler sleeve 26 and the driver sleeve 24 and into corresponding bores 116 defined through the driver sleeve 24 (FIGS. 7A–7B). In its normal position, the tumbler pins lock the driver sleeve 24 and connected spindle 34 against rotational movement relative to the tumbler sleeve 26.

However, such rotational motion is permitted if the tumbler pins are displaced rearwardly against the urging of the compression springs in such a fashion that the forward ends of all the tumbler pins lie exactly at the shear plane 114. This rearward displacement of the tumbler pins is effected by driver pins 28 positioned in an axially slidable manner within the bores 116 of the driver sleeve in such a way that the inner ends of the drive pins engage the outer ends of the corresponding tumbler pins. Generally, at least some of the driver pins are of different lengths so that alignment of all tumbler pins at the shear plane necessarily require the displacement of different driver pins by different predetermined distances. This requires the use of a properly coded key 32 to displace the driver pins through the predetermined distances in order to cause the rear ends of all of the tumbler pins to be simultaneously aligned at the shear plane so that the spindle 34 may be rotated. Coding of such conventional tumbler locks is accomplished by placing driver pins 28 of varying lengths inside predetermined bores 116 located in the driver sleeve 24.

As can be seen from the foregoing detailed description, this invention provides a computer equipment lock of an axial pin tubular configuration which is highly-resistant to picking or other disengagement techniques. Further, the computer lock as described above may be easily and economically manufactured and is based on a well understood and uncomplicated locking mechanism.

I claim as my invention:

1. An improved lock construction for use in securing portable devices equipped with lock-accepting ports, said lock comprising, in combination:

an outer shell having forward and rearward ends, said outer shell including receiving means for accepting cable means, said rear end of said outer shell comprising a body portion and a protective rear plate portion, an inner shell housed within said outer shell, a rotatable driver sleeve telescoped into the forward portion of said inner shell, a stationary tumbler sleeve disposed rearward of said rotatable driver sleeve in face-to-face relation with the rear end of said rotatable driver sleeve, a locking spindle extending through, and rotatably mounted in, said stationary tumbler sleeve, said spindle comprising a body portion, a neck portion and a head portion, said head portion engageable with said lock-accepting portion on said device, anti-rotation extensive means engageable with said lock-accepting port on said device, said extensive means precluding rotational manipulation of the lock following engagement between said spindle and said lock-accepting port, means for translating rotation of said driver sleeve to said spindle, driver and tumbler pins slidably mounted in axially extending and angularly spaced holes defined in said stationary tumbler sleeve and said rotatable driver sleeve and normally operable to prevent rotation of said spindle with respect to said stationary tumbler sleeve, retaining means disposed in face-to-face relation with the rearward end of said tumbler sleeve, said face-to-face relation between said retaining means and said tumbler sleeve maintained by spring means disposed between said retaining means and the rearward portion of said outer shell.

2. The lock construction of claim 1 wherein said anti-rotation extensive means are integrally formed with said retaining means.

3. The lock construction of claim 1, wherein said head and neck portions of said locking spindle form a substantially T-shaped structure lockingly engageable with slotted ports on said device.

4. The lock construction of claim 3 wherein the greatest cross sectional dimension of said spindle head portion is greater than the greatest cross sectional dimension of said spindle body portion.

5. The lock construction of claim 4 wherein the smallest cross sectional dimension of said spindle head portion is equivalent to the diameter of the spindle neck portion.

6. The lock construction of claim 1, wherein said protective plate portion of the rear end of said outer shell is retained in place by adhesive means as well as by cooperative geometric engagement between said plate portion and said body portion of the rear end of said outer shell.

7. An apparatus for inhibiting theft of equipment having an external wall with a rectangular slot with preselected dimensions, the improvement comprising an attachment mechanism including a housing, a spindle including a first portion rotatably mounted with the housing, a shaft fixed to the first portion and extending outwardly from the housing, and a crossmember conforming closely to the preselected dimensions of the slot and abutment means emanating from the housing and located on opposite sides of the shaft intermediate the housing and the crossmember, the abutment means and the shaft having cross-sectional dimensions closely conforming to the dimensions of the slot so that the crossmember, the shaft and the abutment means are insertable into the slot with the crossmember aligned with the abutment means to a position in which the crossmember is inside the external wall and the abutment means and the shaft occupy the slot, the spindle is rotatable 90 degrees by a locking mechanism to misalign the crossmember with the slot and the abutment means to attach the attachment mechanism rigidly to the external wall;

wherein the housing additionally includes a spring for biasing the housing against the external wall upon attachment of the attachment means to the equipment, and a cable connected to an immovable object and secured to the housing to inhibit theft of the equipment.

* * * * *

US005327752C1

(12) EX PARTE REEXAMINATION CERTIFICATE (5673rd)

United States Patent
Myers et al.

(10) Number: US 5,327,752 C1
(45) Certificate Issued: Feb. 20, 2007

(54) COMPUTER EQUIPMENT LOCK

(75) Inventors: Gary L. Myers, River Grove, IL (US); Stewart Carl, Palo Alto, CA (US); Arthur H. Zarnowitz, Burlingame, CA (US)

(73) Assignee: Kensington Microware Ltd., San Mateo, CA (US)

Reexamination Request:
No. 90/007,674, Aug. 19, 2005

Reexamination Certificate for:

| | |
|---|---|
| Patent No.: | **5,327,752** |
| Issued: | **Jul. 12, 1994** |
| Appl. No.: | **08/119,314** |
| Filed: | **Sep. 9, 1993** |

Related U.S. Application Data

(63) Continuation of application No. 07/891,783, filed on Jun. 1, 1992, now abandoned.

(51) Int. Cl.
*E05B 69/00* (2006.01)

(52) U.S. Cl. ..... 70/58; 70/14; 70/57; 70/491; 248/553; D8/331

(58) Field of Classification Search ..... 70/14, 70/57, 58, 491; 248/553
See application file for complete search history.

(56) References Cited

U.S. PATENT DOCUMENTS

| | | | |
|---|---|---|---|
| 87,045 | A | 2/1869 | Holmes |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |

(Continued)

FOREIGN PATENT DOCUMENTS

| | | |
|---|---|---|
| CA | 454901 | 3/1949 |
| CA | 791364 | 8/1968 |
| CA | 987121 | 4/1976 |
| DE | 329934 | 12/1920 |
| DE | 335741 | 4/1921 |

(Continued)

OTHER PUBLICATIONS

U.S. Appl. No. 09/441,142, Murray et al.
U.S. Appl. No. 09/603,240, Murray et al.
U.S. Appl. No. 09/603,394, Murray et al.
U.S. Appl. No. 09/804,973, Murray et al.
U.S. Appl. No. 10/455,072, Kuo.

(Continued)

*Primary Examiner*—Jimmy G. Foster

(57) ABSTRACT

An axial pin tubular lock for use in securing portable computers and other devices having spindle-accepting ports. The lock is bade up of an outer shell attached to a cable, an inner shell, a rotatable driver sleeve, a stationary tumbler sleeve, a rear scuff plate held in place by a combination of an adhesive and cooperative geometric engagement with the outer shell, a locking spindle extending through the driver and tumbler sleeves, a retaining plate and an anti-rotation extension which may be integrally formed with the retaining plate. The rotatable driver sleeve is equipped with an internally disposed detent which engage a groove on the spindle, thereby providing proper axial and radial alignment between the spindle and the driver sleeve. The internal surface of the stationary tumbler sleeve has an indented support surface, thus providing spindle support while permitting passage of the spindle head through the tumbler sleeve during assembly. The tumbler sleeve is held in place by a pin which engages a slot located on the sleeve's outer perimeter and by the retaining plate which is diposed against the sleeve's rearward face. The retaining plate is, in turn, held in place by both a spring and the spline detail of the inner shell. The spindle itself incorporates a curved surface design which distributes forces more evenly across the spindle surface, thereby reducing the potential for spindle failure.

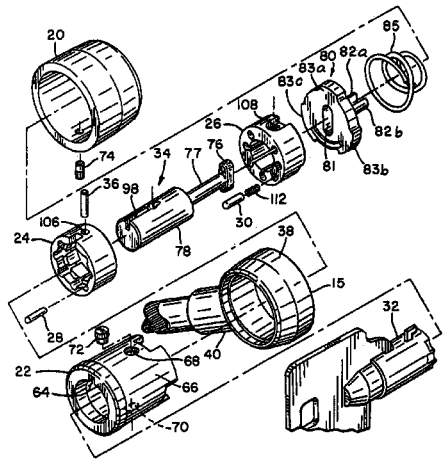

U.S. PATENT DOCUMENTS

| | | | | | |
|---|---|---|---|---|---|
| 786,842 | A | | 4/1905 | Robeson | |
| 881,364 | A | | 3/1908 | Wheeler | |
| 934,928 | A | | 9/1909 | Michel | |
| 942,537 | A | | 12/1909 | Batdorf | |
| 952,411 | A | | 3/1910 | Billy | |
| 1,004,333 | A | | 9/1911 | Alsterberg | |
| 1,050,276 | A | | 1/1913 | Johnson | |
| 1,101,450 | A | | 6/1914 | Kerry | |
| 1,432,546 | A | | 10/1922 | Gillom | |
| 1,452,471 | A | | 4/1923 | Kline | |
| 1,470,937 | A | | 10/1923 | Schou | |
| 1,534,936 | A | | 4/1925 | Fishchbach | |
| 1,672,333 | A | | 6/1928 | Miller | |
| 1,786,511 | A | | 12/1930 | Warren | |
| 1,978,935 | A | | 10/1934 | Douglas | |
| 2,001,354 | A | | 5/1935 | Smith | |
| 2,102,583 | A | | 12/1937 | Alberg | |
| 2,109,109 | A | | 2/1938 | Finch | |
| 2,130,216 | A | | 9/1938 | Zaninovich | |
| 2,172,208 | A | * | 9/1939 | Kurtzon | 70/14 |
| 2,190,661 | A | | 2/1940 | Hauer | |
| 2,383,397 | A | | 8/1945 | Lofqwist | |
| 2,405,400 | A | | 8/1946 | Butterfiled | |
| 2,435,876 | A | | 2/1948 | De Swart | |
| 2,469,874 | A | | 5/1949 | Fetsko, Jr. | |
| 2,480,682 | A | | 8/1949 | McKinzie | |
| 2,530,560 | A | | 11/1950 | Young | |
| 2,577,956 | A | | 12/1951 | Elsberg | |
| 2,594,012 | A | | 4/1952 | Griffin | |
| 2,660,084 | A | | 11/1953 | Newman | |
| 2,677,261 | A | | 5/1954 | Jacobi | |
| 2,729,418 | A | | 1/1956 | Maynard | |
| 2,800,090 | A | | 7/1957 | Reid | |
| 2,963,310 | A | | 12/1960 | Abolins | |
| 3,091,011 | A | | 5/1963 | Campbell | |
| 3,101,695 | A | | 8/1963 | Honeyman, Jr. | |
| 3,130,571 | A | | 4/1964 | Neumann | |
| 3,136,017 | A | | 6/1964 | Preziosi | |
| 3,171,182 | A | | 3/1965 | Danehy | |
| 3,174,384 | A | | 3/1965 | Vanni | |
| 3,200,694 | A | | 8/1965 | Rapata | |
| 3,211,408 | A | | 10/1965 | Schaefer | |
| 3,213,745 | A | | 10/1965 | Dwyer | |
| 3,220,077 | A | | 11/1965 | Newcomer, Jr. et al. | |
| 3,276,835 | A | | 10/1966 | Hall | |
| 3,469,874 | A | | 9/1969 | Mercurio | |
| 3,486,158 | A | | 12/1969 | Soltysik et al. | |
| 3,521,845 | A | | 7/1970 | Sweda et al. | |
| 3,590,608 | A | | 7/1971 | Smyth et al. | |
| 3,625,031 | A | | 12/1971 | Alley, III | |
| 3,634,963 | A | | 1/1972 | Hermann | |
| 3,664,163 | A | | 5/1972 | Foote | |
| 3,722,239 | A | | 3/1973 | Mestre | |
| 3,727,934 | A | | 4/1973 | Averbook et al. | |
| 3,737,135 | A | | 6/1973 | Bertolini | |
| 3,754,420 | A | | 8/1973 | Oellerich | |
| 3,765,197 | A | | 10/1973 | Foote | |
| 3,771,338 | A | | 11/1973 | Raskin | |
| 3,772,645 | A | | 11/1973 | Odenz et al. | |
| 3,782,146 | A | | 1/1974 | Franke | |
| 3,785,183 | A | | 1/1974 | Sander | |
| 3,798,934 | A | | 3/1974 | Wright et al. | |
| 3,826,510 | A | | 7/1974 | Halter | |
| D232,416 | S | | 8/1974 | Gazda et al. | |
| 3,836,704 | A | | 9/1974 | Coules | |
| 3,859,826 | A | | 1/1975 | Singer et al. | |
| 3,866,873 | A | | 2/1975 | Bohli | |
| 3,875,645 | A | | 4/1975 | Tucker et al. | |
| 3,905,570 | A | | 9/1975 | Nieuwveld | |
| 3,910,079 | A | | 10/1975 | Gassaway | |
| 3,910,081 | A | | 10/1975 | Pender | |
| 3,939,752 | A | | 2/1976 | Koscik | |
| 3,986,780 | A | | 10/1976 | Nivet | |
| 3,990,276 | A | | 11/1976 | Shontz | |
| 3,999,410 | A | | 12/1976 | Hall | |
| 4,003,228 | A | | 1/1977 | Lievens et al. | |
| 4,004,440 | A | | 1/1977 | Dreyer | |
| 4,007,613 | A | | 2/1977 | Gassaway | |
| 4,018,339 | A | | 4/1977 | Pritz | |
| 4,028,913 | A | | 6/1977 | Falk | |
| 4,028,916 | A | | 6/1977 | Pender | |
| 4,047,748 | A | | 9/1977 | Whaley et al. | |
| 4,055,973 | A | | 11/1977 | Best | |
| 4,057,984 | A | * | 11/1977 | Avaiusini | 70/58 |
| 4,065,083 | A | | 12/1977 | Gassaway | |
| 4,066,195 | A | | 1/1978 | Dickler | |
| 4,066,231 | A | | 1/1978 | Bahner | |
| 4,104,951 | A | | 8/1978 | Leitner | |
| 4,114,409 | A | | 9/1978 | Scire | |
| 4,118,902 | A | | 10/1978 | Saxton | |
| 4,123,922 | A | | 11/1978 | Kuenstler | |
| 4,131,001 | A | | 12/1978 | Gotto | |
| 4,212,175 | A | | 7/1980 | Zakow | |
| 4,223,542 | A | | 9/1980 | Basseches | |
| 4,252,007 | A | | 2/1981 | Kerley | |
| 4,263,833 | A | | 4/1981 | Loudin | |
| 4,300,371 | A | | 11/1981 | Herwick et al. | |
| 4,311,883 | A | | 1/1982 | Kidney | |
| 4,337,462 | A | | 6/1982 | Lemelson | |
| 4,391,110 | A | | 7/1983 | Nielsen | |
| 4,394,101 | A | | 7/1983 | Richer | |
| 4,418,550 | A | | 12/1983 | Hamilton | |
| 4,419,034 | A | | 12/1983 | DiMartino | |
| 4,442,571 | A | | 4/1984 | Davis et al. | |
| 4,448,049 | A | | 5/1984 | Murray | |
| 4,462,233 | A | | 7/1984 | Horetzke | |
| 4,466,259 | A | | 8/1984 | Osgood | |
| 4,471,980 | A | | 9/1984 | Hickman | |
| 4,478,545 | A | | 10/1984 | Mizusawa | |
| 4,501,460 | A | | 2/1985 | Sisler | |
| 4,502,305 | A | | 3/1985 | Bakker | |
| 4,527,405 | A | | 7/1985 | Renick et al. | |
| 4,570,465 | A | * | 2/1986 | Bennett | 70/18 |
| 4,579,492 | A | | 4/1986 | Kazino | |
| 4,584,856 | A | | 4/1986 | Petersdorff et al. | |
| 4,586,843 | A | | 5/1986 | Henge et al. | |
| 4,593,273 | A | | 6/1986 | Narcisse | |
| 4,598,272 | A | | 7/1986 | Cox | |
| 4,603,829 | A | | 8/1986 | Koike et al. | |
| 4,610,587 | A | | 9/1986 | Wollar | |
| 4,616,490 | A | | 10/1986 | Robbins | |
| 4,640,106 | A | | 2/1987 | Derman | |
| 4,651,544 | A | | 3/1987 | Hungerford | |
| 4,655,057 | A | | 4/1987 | Derman | |
| 4,656,848 | A | | 4/1987 | Rose | |
| 4,667,491 | A | | 5/1987 | Lokken et al. | |
| 4,676,080 | A | | 6/1987 | Schwarz | |
| 4,680,949 | A | | 7/1987 | Stewart | |
| 4,685,312 | A | | 8/1987 | Lakoski et al. | |
| 4,691,891 | A | | 9/1987 | Dionne | |
| 4,692,968 | A | | 9/1987 | Girard | |
| 4,704,881 | A | | 11/1987 | Sloop, Sr. | |
| 4,733,840 | A | * | 3/1988 | D'Amore | 248/205.3 |
| 4,738,428 | A | * | 4/1988 | Themistos et al. | 248/551 |
| 4,741,185 | A | | 5/1988 | Weinert et al. | |
| 4,768,361 | A | | 9/1988 | Derman | |
| 4,770,583 | A | | 9/1988 | Lindberg | |
| 4,779,434 | A | | 10/1988 | Derman | |
| 4,785,291 | A | | 11/1988 | Hawthorne | |
| 4,801,232 | A | | 1/1989 | Hempel | |
| 4,804,943 | A | | 2/1989 | Soleimani | |

| | | | | |
|---|---|---|---|---|
| 4,805,426 | A | | 2/1989 | Dimmick et al. |
| 4,813,252 | A | | 3/1989 | Ray |
| 4,826,193 | A | | 5/1989 | Davis |
| 4,834,600 | A | | 5/1989 | Lemke |
| 4,842,912 | A | | 6/1989 | Hutter, III |
| 4,843,848 | A | | 7/1989 | Igelmund |
| 4,856,304 | A | | 8/1989 | Derman |
| 4,856,305 | A | | 8/1989 | Adams |
| 4,858,455 | A | * | 8/1989 | Kuo ..... 70/491 |
| 4,862,716 | A | | 9/1989 | Derman |
| 4,869,082 | A | | 9/1989 | Appelbaum |
| 4,870,840 | A | | 10/1989 | Klein |
| 4,893,488 | A | | 1/1990 | Klein |
| 4,907,111 | A | | 3/1990 | Derman |
| 4,907,716 | A | | 3/1990 | Wankel et al. |
| 4,918,952 | A | | 4/1990 | Lakoski et al. |
| 4,924,683 | A | | 5/1990 | Derman |
| 4,924,693 | A | | 5/1990 | College |
| 4,938,040 | A | * | 7/1990 | Humphreys, Jr. ..... 70/58 |
| 4,959,635 | A | | 9/1990 | Wilson |
| 4,959,979 | A | | 10/1990 | Filipow et al. |
| 4,964,285 | A | | 10/1990 | Lakoski |
| 4,966,511 | A | | 10/1990 | Lee |
| 4,969,342 | A | | 11/1990 | Marchiori |
| 4,978,265 | A | | 12/1990 | DeWan |
| 4,979,382 | A | | 12/1990 | Perry |
| 4,985,695 | A | | 1/1991 | Wilkinson et al. |
| 4,986,097 | A | | 1/1991 | Derman |
| 4,993,244 | A | | 2/1991 | Osman |
| 5,001,460 | A | | 3/1991 | Basson |
| 5,001,854 | A | | 3/1991 | Derman |
| 5,010,748 | A | | 4/1991 | Derman |
| 5,022,242 | A | | 6/1991 | Povilaitis |
| 5,024,072 | A | | 6/1991 | Lee |
| 5,027,627 | A | | 7/1991 | Derman |
| 5,050,836 | A | | 9/1991 | Makous |
| 5,052,199 | A | | 10/1991 | Derman |
| 5,063,763 | A | | 11/1991 | Johnson |
| 5,067,151 | A | | 11/1991 | Inagaki |
| 5,076,079 | A | | 12/1991 | Monoson |
| 5,082,232 | A | | 1/1992 | Wilson |
| 5,082,233 | A | | 1/1992 | Ayers et al. |
| 5,099,663 | A | | 3/1992 | Dearstine |
| 5,117,661 | A | | 6/1992 | Carl et al. |
| 5,119,649 | A | | 6/1992 | Spence |
| 5,135,197 | A | | 8/1992 | Kelley et al. |
| 5,138,785 | A | | 8/1992 | Paterson |
| 5,146,769 | A | | 9/1992 | Smith |
| 5,154,456 | A | | 10/1992 | Moore |
| 5,184,798 | A | | 2/1993 | Wilson |
| 5,197,706 | A | | 3/1993 | Braithwaite et al. |
| 5,223,815 | A | | 6/1993 | Rosenthal et al. |
| D337,040 | S | | 7/1993 | Carl |
| 5,228,319 | A | | 7/1993 | Holley et al. |
| 5,279,136 | A | | 1/1994 | Perry |
| 5,317,304 | A | | 5/1994 | Choi |
| D350,473 | S | | 9/1994 | Simon |
| 5,349,834 | A | | 9/1994 | Davidge |
| 5,351,507 | A | | 10/1994 | Derman |
| 5,351,508 | A | | 10/1994 | Kelley |
| 5,361,610 | A | | 11/1994 | Sanders |
| 5,370,488 | A | | 12/1994 | Sykes |
| 5,377,512 | A | | 1/1995 | Kelley |
| 5,381,685 | A | | 1/1995 | Carl et al. |
| 5,390,514 | A | | 2/1995 | Harmon |
| 5,390,977 | A | | 2/1995 | Miller |
| 5,394,713 | A | | 3/1995 | Harmon |
| 5,397,171 | A | | 3/1995 | Leach |
| 5,398,530 | A | | 3/1995 | Derman |
| 5,400,622 | A | | 3/1995 | Harmon |
| 5,406,809 | A | | 4/1995 | Igelmund |
| 5,412,959 | A | | 5/1995 | Bentley |
| 5,421,667 | A | | 6/1995 | Leyden et al. |
| 5,466,022 | A | | 11/1995 | Derman |
| 5,473,917 | A | | 12/1995 | Say |
| 5,489,173 | A | | 2/1996 | Hofle |
| 5,493,878 | A | | 2/1996 | Murray et al. |
| 5,502,989 | A | | 4/1996 | Murray et al. |
| 5,520,031 | A | | 5/1996 | Davidge |
| D370,473 | S | | 6/1996 | Derman |
| 5,548,981 | A | | 8/1996 | Kirk |
| 5,579,657 | A | | 12/1996 | Makous |
| 5,593,878 | A | | 1/1997 | Knopf et al. |
| 5,603,416 | A | | 2/1997 | Richardson et al. |
| 5,608,605 | A | | 3/1997 | Siow et al. |
| 5,611,223 | A | | 3/1997 | Spitzer |
| 5,622,064 | A | | 4/1997 | Gluskoter et al. |
| 5,687,592 | A | | 11/1997 | Penniman |
| 5,692,400 | A | | 12/1997 | Bliven et al. |
| 5,709,110 | A | | 1/1998 | Greenfield et al. |
| 5,722,268 | A | | 3/1998 | Choi |
| 5,787,739 | A | | 8/1998 | Derman |
| 5,791,171 | A | | 8/1998 | Kelley |
| 5,794,463 | A | | 8/1998 | McDaid |
| 5,836,183 | A | | 11/1998 | Derman |
| 5,870,281 | A | | 2/1999 | Kim |
| 5,875,657 | A | | 3/1999 | Kelley |
| 5,913,907 | A | | 6/1999 | Lee |
| 5,963,131 | A | | 10/1999 | D'Angelo et al. |
| 5,983,679 | A | | 11/1999 | Reyes |
| 6,000,251 | A | | 12/1999 | Murray et al. |
| 6,000,252 | A | | 12/1999 | Murray et al. |
| 6,006,557 | A | | 12/1999 | Carl et al. |
| 6,038,891 | A | | 3/2000 | Zeren et al. |
| 6,058,744 | A | | 5/2000 | Ling |
| 6,081,974 | A | | 7/2000 | McDaid |
| 6,112,561 | A | | 9/2000 | Carl |
| 6,112,562 | A | | 9/2000 | Murray, Jr. et al. |
| 6,133,830 | A | | 10/2000 | D'Angelo et al. |
| 6,155,088 | A | | 12/2000 | Murray, Jr. et al. |
| 6,170,364 | B1 | | 1/2001 | Johnson |
| 6,173,591 | B1 | | 1/2001 | Derman |
| 6,199,413 | B1 | | 3/2001 | McDaid et al. |
| 6,205,824 | B1 | | 3/2001 | Miao |
| 6,212,918 | B1 | | 4/2001 | Krautin |
| 6,227,017 | B1 | | 5/2001 | Ingelmund |
| 6,244,080 | B1 | | 6/2001 | Sakurai |
| 6,257,029 | B1 | | 7/2001 | Liao |
| 6,265,974 | B1 | | 7/2001 | D'Angelo et al. |
| 6,301,940 | B1 | | 10/2001 | Derman et al. |
| 6,317,936 | B1 | | 11/2001 | McDaid et al. |
| 6,360,405 | B1 | | 3/2002 | McDaid et al. |
| 6,401,502 | B1 | | 6/2002 | Yang |
| 6,449,992 | B1 | | 9/2002 | Yu |
| 6,513,350 | B1 | | 2/2003 | Hurd et al. |
| 6,553,794 | B1 | | 4/2003 | Murray, Jr. et al. |
| 6,588,241 | B1 | | 7/2003 | Murray, Jr. et al. |
| 6,591,642 | B1 | | 7/2003 | Kuo |
| 6,735,990 | B1 | | 5/2004 | Murray, Jr. et al. |
| 6,758,069 | B2 | | 7/2004 | Derman |
| 2003/0101778 | A1 | | 6/2003 | Carl et al. |
| 2004/0040350 | A1 | | 3/2004 | Derman |
| 2004/0206138 | A1 | | 10/2004 | Murray et al. |
| 2005/0150262 | A1 | | 7/2005 | Murray et al. |
| 2005/0150263 | A1 | | 7/2005 | Murray et al. |
| 2005/0178173 | A1 | | 8/2005 | Kuo |

FOREIGN PATENT DOCUMENTS

| | | |
|---|---|---|
| DE | 361068 | 4/1923 |
| DE | 456219 | 2/1928 |
| DE | 557757 | 8/1932 |
| DE | 3202700 | 8/1983 |

| | | | |
|---|---|---|---|
| DE | 3407723 | A1 | 9/1985 |
| DE | 3824393 | C1 | 7/1989 |
| DE | 3824393 | | 7/1989 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234656 | A | 2/1991 |
| IT | 451949 | | 10/1949 |
| JP | 37-7592 | | 9/1935 |
| JP | 49-91096 | | 11/1947 |
| JP | 57-25092 | | 2/1957 |
| JP | 52-36813 | | 9/1976 |
| JP | 57-179618 | | 11/1982 |
| NO | 14095 | | 5/1905 |
| WO | WO 95/10680 | | 4/1985 |
| WO | WO 86/00396 | | 1/1986 |
| WO | WO 93/15295 | | 8/1993 |
| WO | WO 96/07002 | A1 | 3/1996 |

OTHER PUBLICATIONS

U.S. Appl. No. 10/839,521, Murray et al.
U.S. Appl. No. 90/007,225, Stewart et al.
U.S. Appl. No. 90/007,221, Murray et al.
U.S. Appl. No. 10/970,060, Merrem et al.
U.S. Appl. No. 11/000,397, Merrem et al.
U.S. Appl. No. 11/009,813, Murray et al.
U.S. Appl. No. 11/009,335, Murray et al.
U.S. Appl. No. 11/035,946, Kuo.
Kablit Security System Catalog, pp. 7, 93, 1988. Computer and Office Equipment Security Catalog, 1990, Secure–It, Inc., 18 Maple Court, East Longmeadow, MA 01028.
Kensington Product Brochure for Kensington Apple Laser Writer and Macintosh Portable Security Systems, Computer and Office Equipment Security Catalog, 1990, Secure–It, Inc., 18 Maple Court, East Longmeadow, MA 01028.
Apple Security Bracket sold in AS kit.
Retaining Device Incorporated in Apple Computers.
U.S. Appl. No. 95/000,116, Murray, Jr. et al.
*ACCO Brands, Inc.* v. *Micro Security Devices, Inc.* Federal Circuit Court Order Granting Defendant's Motion for Summary Judgement, Jul. 23, 2002, 13 pages.
Passproof User Manual 1990, 5 pages.
Flexguard Security System, Philadelphia Security Products (no date on page) (1 page).
Los Angeles Times, Jan. 12, 1989, Part V, p. 10.
Kensington Microsaver Packaging and Manual (copyright 1992), 4 pages.

* cited by examiner

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *